US005294355A

United States Patent [19]

King et al.

[11] Patent Number: 5,294,355

[45] Date of Patent: * Mar. 15, 1994

[54] THERMALLY AND OXIDATIVELY STABLE SOLID LUBRICANTS

[75] Inventors: James P. King, Lansdale; Harold G. Monsimer, Norristown, both of Pa.

[73] Assignee: Desilube Technology, Inc., Lansdale, Pa.

[ * ] Notice: The portion of the term of this patent subsequent to Feb. 18, 2009 has been disclaimed.

[21] Appl. No.: 997,354

[22] Filed: Dec. 28, 1992

[51] Int. Cl.[5] ..... C10M 103/02

[52] U.S. Cl. ..... 252/28; 252/29; 252/30; 252/49.003

[58] Field of Search ..... 252/28, 29, 30, 49.3

[56] References Cited

U.S. PATENT DOCUMENTS

| | | | |
|---|---|---|---|
| 3,242,075 | 3/1966 | Hunter | 252/29 |
| 3,248,250 | 4/1966 | Collins | 106/286 |
| 3,278,328 | 11/1966 | Okrent . | |
| 4,319,926 | 3/1982 | Nowakowski et al. | 106/74 |
| 4,713,186 | 12/1987 | Kristen et al. | 252/30 |
| 4,735,734 | 4/1988 | Staub et al. | 252/29 |
| 4,808,324 | 2/1989 | Periard et al. | 252/30 |
| 4,882,646 | 4/1989 | Clark et al. | 252/29 |
| 5,089,154 | 2/1992 | King | 252/28 |

*Primary Examiner*—Jacqueline V. Howard
*Attorney, Agent, or Firm*—Paul Lipsitz

[57] ABSTRACT

A recirculating powder lubricant delivery system having improved oxidative stability and a lubricant therefor where the lubricant is a solid lubricant selected from a group of molybdenum disulfide, graphite and graphite fluoride, and wherein the solid lubricant is microencapsulated from an aqueous suspension of an alkali metal silicate containing a water soluble phosphate.

18 Claims, No Drawings

THERMALLY AND OXIDATIVELY STABLE SOLID LUBRICANTS

This invention relates to solid lubricants which have improved oxidative stability at very high and extremely high temperatures. In particular, the invention provides such high temperature lubricants by improving the oxidative and thermal stability of the microencapsulated solid lubricants, having oxidative stability up to about 1500° F., which are described and claimed in my U.S. Pat. No. 5,089,154, issued Feb. 18, 1992, which patent is hereby incorporated by reference.

BRIEF DESCRIPTION OF THE INVENTION

This invention provides solid lubricants, such as graphite, molybdenum disulfide, and graphite fluoride, which are microencapsulated by spray-drying from an aqueous alkali metal silicate system containing a water-soluble phosphate, which phosphate additive significantly enhances the oxidative and thermal properties of the lubricant.

DESCRIPTION OF THE PRIOR ART

The coating and microencapsulation of various solids is discussed in my U.S. Pat. No. 5,089,154 referenced above.

U.S. Pat. No. 3,248,250 discloses the formation of coatings on substrates such as steel panels by spraying or dipping onto the surface of the panel an aqueous phosphate solution comprising solid particulate molecules, including graphite and molybdenum disulfide, and, as an additive, a soluble silicate. The composition applied to the panels is then dried and cured to water insolubility. The phosphate imparts the usual anticorrosion resistance and the added silicate reduces the curing temperature while the solid particulates which may be added, such as graphite, impart lubricity to the treated surface. There is no disclosure, however, to microencapsulation of a solid lubricant with a silicate to provide the high temperature lubricants of this invention.

U.S. Pat. No. 3,278,328 also discloses the coating of substrates with inorganic polyphosphates and may include a solid such as graphite and molybdenum disulfide into the phosphate film which is said "seem to provide some structure enhancing or cross-linking function" and increase the durability and flexibility of the polymer fibers. There is no reference to the microencapsulated lubricants of this invention.

U.S. Pat. No. 4,319,926 similarly discloses an aqueous coating composition comprised of an alkali metal silicate and a phosphate hardener, which composition may also include a solid pigment such as iron oxide, titanium oxide, carbon black and the like. There is no disclosure of lubricant compositions.

DETAILED DESCRIPTION OF THE INVENTION

As indicated above, this invention provides improved high temperature and oxidatively stable lubricants of graphite, graphite fluoride and molybdenum disulfide which are microencapsulated by spray drying from an aqueous system comprised of a solid lubricant, a water-soluble silicate and a water-soluble phosphate additive. These lubricants are particularly useful in the recirculating powder lubricant delivery systems which are used in high and extremely high temperature engines such as ceramic engines and such use is described in my U.S. Pat. No. 5,089,154 referenced above.

In preparing the encapsulated composition for use in the invention, the solid material to be encapsulated is usually added at ambient temperature to a dilute solution of the water-soluble phosphate and the aqueous silicate solution and any other components then added. However, the order of addition is not critical and the reagents may be added in any order. The solid lubricant, preferably graphite, will be used in an amount of from about 50% to 75% by weight of total solids in the mixture to be encapsulated by spraying. The amount of phosphate will be from about 10% to about 50% by weight, preferably from about 15% to about 45% of the solids to be sprayed. The water-soluble phosphates will be mono-, di-, and tri-basic phosphoric acids and their salts. Polyphosphoric acid (which hydrolyzes to $H_3PO_4$), monoaluminum dihydrogen phosphate ($Al(H_2PO_4)_3$) and soluble magnesium phosphates such as magnesium biphosphate are the preferred phosphates. Most preferred is monoaluminum dihydrogen phosphate which gives products having the best performance. In general, acid phosphates are the preferred materials. The aqueous solution of the alkali metal siilcate is added with stirring for about one hour to ensure thorough mixing. The amount of the silicate used may vary from about 1% to about 30% by weight of total solids in the suspension to be encapsulated by spraying. Preferably, from about 3% to about 30% of silicate will be used. Preferably, the alkali metal silicate will be sodium or potassium silicate. The dispersion is then spray dried to yield a lubricant powder with superior high temperature properties. The precipitation of soluble silicates by acids and by many metal ions is well known. Thus, it is expected that these gelatinous precipitates would clog the equipment and make spray drying difficult, if not impossible. However, by operating within the above concentration range of phosphate and silicate and by stirring rapidly as the phosphate or silicate component is added slowly, such coagulation is retarded for from six to twelve hours which provides sufficient time to spray dry the mixture.

It is also desirable to include up to about 20% by weight on a solids basis of a colloidal alumina in the mixture to be spray dried. The colloidal aluminum oxide (fumed aluminum oxide) acts to reduce the hygroscopicity of the lubricant powder. The amount of alumina used will be from about 2% to about 15% and preferably from about 2% to about 5%.

In general, the sprayable dispersions employed will contain from about 25% to about 60% total of solids with the higher amounts being preferred when using large scale commercial spraying equipment. Particle size of the solids in the sprayable dispersions will generally be in the range of from about 5 to about 100 millimicrons.

EXPERIMENTAL DETAILS

The microencapsulated solid lubricants were evaluated for their oxidative and thermal stability by weight loss measurements at high temperatures. These weight loss tests were carried out as follows:

Approximately 0.2 g. of each sample to be evaluated was spread into 4×1.7 inch boats to give approximately equal surface area to all samples. The boats were carefully weighed with and without sample to 0.0001 g.. The samples were then heated in a muffle furnace for the desired time interval, cooled in a desiccator and again weighed to calculate the percent loss of solid. The weight losses reported are corrected for the ash remaining after complete oxidation of carbon.

It should be understood that variations of furnace temperature, initial humidity and timing made reproductions of exact weight loss from one example to another difficult. For those materials which were run respectively under identical conditions, variation was found to be +/−5%. For this reason, the data in each table was collected from a single set of experiments and a control or bench mark material was included in many examples to provide better precision for comparison.

EXAMPLE 1

Spray Drying of 99+% Graphite-Potassium Silicate Mixture

Dilution of 32.0 g. of Kasil-1 (an aqueous solution of potassium silicate containing approximately 30% solids and a ratio of $K_2O:SiO_2$ of 1:2.5) with water to 85 ml. of volume gave a solution containing approximately 11.64% solids. (Kasil-1 is a trademark of PQ Corporation, Philadelphia, Pa.) To this solution was added three drops of oleic acid as a surfactant to wet the solid surfaces and ensure good coatings. Three drops of 50% potassium hydroxide were added which were followed by 15 g. of 99+% graphite. After a smooth suspension was obtained, the resulting slurry was fed into a Buchi mini-spray dryer using the following conditions: Input temperature 135° C.; Outlet temperature 90°-96° C.; Air flow 600; and pump setting of 2. A total of 20.4 g. of product was collected.

EXAMPLE 2

Spray Drying of Graphite-Silicate-Phosphate Mixture

To a fresh solution of 5.0 g. of polyphosphoric acid in 35 ml. of water was added with stirring 15 g. of 99+% graphite. Then, 15.0 g. of Quaternary Silicate I (a proprietary alkaline silicate product of PQ Corporation which is a sodium silicate to which quaternary ammonium compound Q has been added and whose analysis is 4.6% $Na_2O$, 4.3% $Q_2O$, 24.4% $SiO_2$ and 66.7% $H_2O$) was added dropwise with vigorous stirring. Stirring was continued for one hour, and the resulting slurry was then spray dried using the following conditions: Input temperature 155° C.; Outlet temperature 105°-110° C.; Air flow at 800; and pump setting of 2. A total of 21.9 g. of product was collected.

Table I compares the weight loss in air of plain graphite with that of microencapsulated graphite of Examples 1 and 2.

TABLE I

| | Weight Loss at 750° C. Percent of Loss After | | |
|---|---|---|---|
| Sample | 30 minutes | 60 minutes | 90 minutes |
| Graphite | 90 | 101 | 100 |
| Example 1 | 83 | 87 | 89 |
| Example 2 | 14 | 23 | 26 |

As can be seen from Table I, the use of the phosphate additive (Example 2) results in very much less weight loss compared to the product without it (Example 1) which, in turn, is much better than plain graphite.

EXAMPLE 3

Spray Drying of Graphite-Quaternary Silicate II Using One-Half the Amount of Polyphosphoric Acid Used in Example 2

To a solution of 2.5 g. of polyphosphoric acid in 50 ml. of water was added with stirring 15.0 g. of 99+% graphite. As soon as a smooth slurry was obtained, 13.1 g. of Quaternary Silicate II (a proprietary alkaline silicate from PQ Corporation which is 5.6% $Na_2O$, 3.4% $Q_2O$, 25.2% $SiO_2$ and 65.8% $H_2O$; 34.2% solids and a ratio of $SiO_2:Na_2O$ of 4.5) was added dropwise with stirring. Approximately ⅔ of this slurry was passed through the spray dryer using the following conditions: Input temperature 155° C.; Outlet temperature 105°-110° C.; Air flow at 800; pump setting at 2. A total of 9 g. of product was collected.

Table II indicates that a significant benefit of the phosphate additive is obtained even at one-half the level used in Example 2.

TABLE II

| | Weight Loss at 800° C. Percent of Total Loss After | | |
|---|---|---|---|
| Sample | 15 minutes | 30 minutes | 60 minutes |
| Example 3 | 20 | 27 | 40 |
| Graphite 99% | 65 | 100 | 100 |

EXAMPLE 4

Spray Drying of Graphite-Quaternary Silicate—Phosphoric Acid at a Weight Ratio of 1:1.2:3.6 Based on Solids Content The essential procedure of Example 3 was repeated, but using 5.9 g. of 85% phosphoric acid in place of the polyphosphoric acid, 15 g. of 99+% graphite and 12.7 g. of Quaternary Silicate I. However, the silicate solution was added rapidly instead of dropwise. A total of 14.8 g. of product was collected.

Approximately ⅓ of the charge remained unprocessed due to clogging by coagulated material. The weight loss observed on heating this material is compared with that of pure graphite in Table III.

TABLE III

| | Weight Loss at 800° C. Percent of Total Loss After | |
|---|---|---|
| Sample | 30 minutes | 60 minutes |
| Graphite | 101 | 100 |
| Example 4 | 37 | 46 |

EXAMPLE 5

Spray Drying Graphite-Monoaluminum Dihydrogen Phosphate—Potassium Silicate at a Solids Weight Ratio of 1:5.8:7

A suspension was formed by adding 15.0 g. of graphite to an aqueous solution containing 25 g. of 50% by weight of monoaluminum dihydrogen phosphate and two drops of oleic acid in 40 ml. of water. The mixture was stirred until a smooth slurry was obtained and a solution of 5 g. of Kasil-1 in 20 ml. of water was slowly added. The resulting slurry was spray dried using the following conditions: Input temperature 155° C.; Outlet temperature 105°-110° C.; Air flow at 800; and pump setting of 2. A total of 28.0 g. of product was obtained.

The weight loss on heating in air of this material is shown in Table IV.

TABLE IV

| Sample | Weight Loss at 800° C. Percent of Total Loss After 30 minutes | 60 minutes |
|---|---|---|
| Example 5 | 23.8 | 35.6 |

EXAMPLE 6

Spray Drying Graphite-Monoaluminum Dihydrogen Phosphate-Potassium Silicate Weight Solids Ratio 1:7.5:15

The procedure of Example 5 was followed, but changing the ratio of reactants. To a slurry containing 15 g. of graphite (Fluka 99+%) in a solution of 15 g. of 50% by weight of monoaluminum dihydrogen phosphate in 40 ml. of water was slowly added a solution of 2.5 g. of Kasil-1 in 10 ml. of water. Spray drying gave 20.9 g. of product. The weight loss of constant temperature was 19.8% at 760° C. after 30 minutes.

EXAMPLE 7

Spray Drying various Graphites-Monoaluminum Dihydrogen Phosphate-Potassium Silicate Following the procedure given in Example 5, but substituting Dixon HPN-5 natural graphite, a slurry was obtained from 15.0 g. of graphite, 25 g. of monoaluminum dihydrogen phosphate and 5.0 g. of Kasil-1 which was spray dried to yield 21.0 g. of product. The weight loss at 800° C. after 30 minutes was 20.4% and after 60 minutes, 42.2%.

EXAMPLE 8

Spray Drying of Graphite-Sodium Silicate-Polyphosphoric Acid

Following the procedure shown in Example 2, but substituting sodium silicate as the silicate, a fresh solution of 5.0 g. of polyphosphoric acid in 30 ml. of water was added with stirring 15 g. of graphite (Fluka 99+%). As soon as a smooth slurry was obtained, 10.0 g. of Silicate-K (a trademark of PQ Corporation, Philadelphia, Pa., and which is an aqueous sodium silicate solution containing approximately 43% solids) which had been diluted with 10 ml. of water was added dropwise with vigorous stirring. The resulting slurry was then spray dried using the following conditions: Input temperature 155° C.; Output temperature 105°-110° C.; Air flow at 800; and pump setting of 2. A total of 22.6 g. of product was obtained.

Heating of this product in air is shown in Table Y.

TABLE V

| Sample | Weight Loss at 790° C. Percent of Total Loss After 30 minutes | 60 minutes |
|---|---|---|
| Example 9 | 23.2 | 36.1 |
| Graphite (Fluka) | 99.7 | 99.2 |

EXAMPLE 9

Encapsulation of Graphite Using Polyphosphoric Acid, Sodium Silicate and Alumina To a fresh solution of 5.0 g. of polyphosphoric acid in 30 ml. of water was added with stirring 15.0 g. of graphite (Fluka 99+%). Stirring was continued until a smooth slurry was obtained and 10 g. of Silicate-K diluted with 10 ml. of water was added dropwise, followed by 1.0 g. of fumed alumina (Degussa C), after which the mixture was stirred for 30 minutes. The resulting slurry was fed into a Buchi mini-spray dryer using the following conditions: Input temperature 155° C.; Outlet temperature 105°-110° C.; Air flow at 800; pump setting of 2. A total of 22.8 g. of product was obtained.

Comparison of this material with the bench mark material from the method of Example 2 is shown in Table VI.

TABLE VI

| Sample | Weight Loss at 800° C. Percent of Total Loss After 30 minutes | 60 minutes |
|---|---|---|
| Example 9 | 42.6 | 60.7 |
| Example 2 | 36.0 | 55.4 |

Also of importance here is that due to the presence of the alumina the final product was less hygroscopic than the examples without it and thus, is better able to function as a dry lubricant. More specifically, when the material from this example is compared with material from Example 9 in weight gain under various humidity conditions, it picked up considerably less moisture. For example, at room conditions approximately 80% humidity for 30 minutes, the material from Example 9 gained 15% weight while that from this example gained only 7.5%.

EXAMPLE 10

Spray Drying Molybdenum Disulfide-Monoaluminum Dihydrogen Phosphate-Potassium Silicate A slurry of 30.0 g. of molybdenum disulfide was prepared by stirring in 100 ml. of water containing 9 drops of Triton N-101 surfactant. As soon as the slurry became smooth, 50.0 g. of monoaluminum dihydrogen phosphate was added followed dropwise by addition of a solution of 10 g. of Kasil-1 in 10 ml. of water. The resulting mixture was spray dried using the following conditions: Inlet temperature 174° C.; Outlet temperature 102°-110° C.; Air flow of 800; and pump setting of 4-5. A total of 56 g. of product was obtained.

When this material was heated at 500°-550° C. in air its color remained black, indicating the presence of the encapsulated molybdenum disulfide lubricant. In contrast, when untreated molybdenum disulfide was heated under identical conditions, a white molybdenum oxide was obtained, indicating the complete oxidation of the material. Thermographic analysis (TGA) up to 1000° C. in air at a rate of 10° C. per minute was carried out on the graphite containing and molybdenum sulfide containing lubricant products of the invention. When compared with untreated graphite and molybdenum sulfide, the products of the invention were significantly superior.

EXAMPLE 11

Commercial Scale Preparation of Graphite-Polyphosphoric Acid-Sodium Silicate-Alumina

| TABLE OF INGREDIENTS | Ratio | Pounds | Gallons |
|---|---|---|---|
| Graphite | 15 | 75 | |
| PPA | 5 | 25 | |
| Silicate-K | 10 | 50 | |
| Fumed Alumina | 1 | 5 | |
| Water A (19 gal.) | | 163 | 19 |
| Water B (6 gal.) | | 51 | 6 |
| Water C (4 gal.) | | 34 | 4 |
| Triton N-101 | | 0.5 | |

In a 500-gallon, open, stainless steel tank equipped with a high shear stirrer, 75 pounds of graphite was added to a solution of 0.5 pounds of Triton N-101 surfactant and 25 pounds of polyphosphoric acid in 19 gallons of water; 50 pounds of Silicate-K was diluted with 6 gallons of water and added slowly to the graphite-polyphosphoric acid mixture. The alumina was slurried with about 4 gallons of water containing a small amount of the surfactant and added as a suspension. The resulting mixture was transferred to a stainless steel holding tank and stirred for about 1.5 hours before spraying.

Spraying was started at an inlet temperature of 500° F. and an outlet temperature of 310° F. Final temperatures were: Inlet temperature 600° F.; Outlet temperature 315° F.; wheel speed of 10,000 RPM. Thirty-three pounds of product were collected in the chamber and 68 pounds of fines were collected in the cyclone separator.

| | |
|---|---|
| Material from the chamber: | |
| Weight loss at 130° C. | 3.5% |
| Weight loss at 450° C. | 13.6% |
| Bulk Density | 0.80 |
| Average Particle Size | 73 microns |
| Material from the cyclone: | |
| Weight loss at 130° C. | 2.5% |
| Weight loss at 450° C. | 10.8% |
| Bulk Density | 0.93 |
| Average Particle Size | 41 microns |

EXAMPLE 12

Commercial Scale Preparation of Graphite-Monoaluminum Dihydrogen Phosphate-Potassium Silicate

| TABLE OF INGREDIENTS | Ratio | Pounds | Gallons |
|---|---|---|---|
| Graphite | 3 | 60 | |
| MADP | 5 | 100 | |
| Sodium Silicate | 1 | 20 | |
| Water A | | 160 | 19 |
| Water B | | 80 | 12 |
| Triton N-101 | | 0.5 | |

In a 500-gallon, open, stainless steel tank equipped with a high shear stirrer, 60 pounds of graphite was added to a solution of 0.5 pounds of Triton N-101 surfactant and 100 pounds of 50% monoaluminum dihydrogen phosphate in 19 gallons of water. Twenty pounds of Kasil-1 was diluted with 12 gallons of water and slowly added to the well stirred mixture. This mixture was stirred for approximately 2 hours before it was sprayed.

Spraying was started at an input temperature of 400° F. (204° C.) and outlet temperature of 275° F. (135° C.). The finial outlet temperature was 475° F. (246° C.) and outlet temperature was 305° F. (152° C.) at a wheel speed 3 of 9500 RPM. Thirty-six pounds of product were collected in the chamber and 48 pounds of fines were collected int eh cyclone separator.

| | |
|---|---|
| Material from the chamber: | |
| Weight loss at 130° C. | 3.5% |
| Weight loss at 450° C. | 13.6% |
| Bulk Density | 0.58 |
| Average Particle Size | 76 microns |
| Material from the cyclone: | |
| Weight loss at 130° C. | 2.5% |
| Weight loss at 450° C. | 10.8% |
| Bulk Density | 0.75 |
| Average Particle Size | 43 microns |

EXAMPLE 13

Evaluation of Coefficients of Friction

The high temperature lubricating properties of both encapsulated samples equivalent to Examples 11 and 12 and untreated graphite samples were compared from room temperature to 800° C. The tests were run with the oscillating slider test machine described by Finkin et al., Lubrication Engineering, Vol. 29, No. 5, pp. 197–204, 1973, using silicon nitride against itself. Solid powder was periodically applied during testing. Test conditions were as follows:

| | |
|---|---|
| Specimen geometry: | Hemispherically tipped slider (⅛"radius) vs. flat plate |
| Load: | 32 pounds |
| Sliding motion-reciprocating: | 60 cpm, 6.2 ft./min. |

The coefficients of friction vs. temperature results are shown in Table VII.

TABLE VII

COEFFICIENTS OF FRICTION OF ENCAPSULATED AND UNTREATED GRAPHITE (Silicon Nitride on Silicon Nitride)

| Temp. °C. | Example 11 | Example 12 | Graphite |
|---|---|---|---|
| 50 | 0.14 | 0.13 | 0.60 |
| 100 | 0.18 | 0.22 | 0.64 |
| 200 | 0.32 | 0.32 | 0.41 |
| 300 | 0.22 | 0.20 | 0.34 |
| 400 | 0.14 | 0.12 | 0.20 |
| 500 | 0.08 | 0.05 | 0.16 |
| 600 | 0.08 | 0.10 | 0.16 |
| 700 | 0.16 | 0.10 | 0.18 |
| 800 | 0.04 | 0.05 | 0.30 |

The lubricant compositions of the invention may be readily formed into variously designed solid surfaces to provide a lubricating surface. This is achieved by subjecting the solid lubricant powder to heat and pressure, which procedure is known in the art.

We claim:

1. A solid lubricant having improved high oxidative stability comprising a solid lubricant selected from the group of molybdenum disulfide, graphite and graphite fluoride, wherein said solid lubricant is microencapsulated by spraying from an aqueous suspension of an alkali metal silicate containing a water soluble phosphate.

2. The lubricant of claim 1 wherein said aqueous alkali metal silicate suspension to be sprayed comprises on a total weight of solids basis, from about 1% to about 30% of silicate, from about 50% to about 75% of solid lubricant and from about 10% to about 50% of a water soluble acid phosphate.

3. The lubricant of claim 2 wherein the amount of silicate is from about 3% to about 30% and the amount of phosphate is from about 15% to about 45%.

4. The lubricant of claim 3 wherein the phosphate is polyphosphoric acid.

5. The lubricant of claim 3 wherein the phosphate is phosphoric acid.

6. The lubricant of claim 3 wherein the phosphate is monoaluminum dihydrogen phosphate.

7. A lubricant as in claim 3 wherein the solid lubricant is graphite or molybdenum disulfide.

8. A lubricant as in claim 7 wherein the suspension to be sprayed contains from about 2% to about 5% by weight of fumed alumina.

9. A lubricant as in claim 6 wherein the solid lubricant is graphite or molybdenum disulfide and the suspension to be sprayed contains from about 2% to about 5% of fumed alumina.

10. The lubricant of claim 6 wherein the solid lubricant is graphite or molybdenum disulfide, the silicate is sodium or potassium silicate and the aqueous suspension to be sprayed contains from about 2% to about 5% of a fumed alumina.

11. A recirculating powder lubricant delivery system having improved oxidative stability wherein said recirculating lubricant is a solid lubricant selected from the group consisting of molybdenum disulfide, graphite and graphite fluoride, wherein said solid lubricant is encapsulated by spray drying from a suspension comprised on a total weight of solids basis of from about 50% to about 75% of said solid lubricant, from about 3% to about 30% of an alkali metal silicate and from about 15% to about 45% of a water soluble acid phosphate.

12. The lubricant system of claim 11 wherein the solid lubricant is molybdenum disulfide.

13. The lubricant system of claim 11 wherein the solid lubricant is graphite.

14. The lubricant system of claim 11 wherein the solid lubricant is graphite or molybdenum disulfide and the phosphate is monoaluminum dihydrogen phosphate.

15. The lubricant system of claim 11 wherein the solid lubricant is graphite and molybdenum disulfide and the phosphate is polyphosphoric acid.

16. The lubricant system of claim 11 wherein the solid lubricant is graphite or molybdenum disulfide and the phosphate is phosphoric acid.

17. The lubricant system of claim 14 wherein the silicate is sodium or potassium silicate and wherein said suspension contains from about 2% to about 5% of fumed alumina.

18. A recirculating powder lubricant delivery system having improved oxidative stability wherein said recirculating lubricant is a solid lubricant selected from the group consisting of molybdenum disulfide, graphite and graphite fluoride, wherein said solid lubricant is encapsulated by spray drying from a suspension comprised on a total weight of solids basis of from about 50% to about 75% of said solid lubricant, from about 1% to about 30% of an alkali metal silicate, from about 10% to about 45% of monoaluminum dihydrogen phosphate and from about 2% to about 5% of fumed alumina.

* * * * *